US011457739B2

(12) United States Patent
Putzke

(10) Patent No.: US 11,457,739 B2
(45) Date of Patent: Oct. 4, 2022

(54) CHAIR LEG MOUNTABLE COASTER ASSEMBLY

(71) Applicant: Michael Putzke, Paynesville, MN (US)

(72) Inventor: Michael Putzke, Paynesville, MN (US)

( * ) Notice: Subject to any disclaimer, the term of this patent is extended or adjusted under 35 U.S.C. 154(b) by 0 days.

(21) Appl. No.: 16/731,686

(22) Filed: Dec. 31, 2019

(65) Prior Publication Data

US 2021/0196045 A1 Jul. 1, 2021

(51) Int. Cl.
*A47B 91/06* (2006.01)
*A47C 3/04* (2006.01)

(52) U.S. Cl.
CPC ..... *A47B 91/06* (2013.01); *A47C 3/04* (2013.01)

(58) Field of Classification Search
CPC ..... A47B 91/06; A47C 7/002
See application file for complete search history.

(56) References Cited

U.S. PATENT DOCUMENTS 1,659,540 A * 2/1928 Larsen ..... A47B 91/06 16/42 R
3,099,891 A * 8/1963 Handler ..... A47B 91/06 248/188.9
3,254,362 A * 6/1966 Rasor ..... A47B 91/06 16/42 R
3,342,445 A * 9/1967 Bouwkamp ..... A47B 91/06 248/188.9
3,586,277 A 6/1971 Voris
3,755,853 A * 9/1973 Barile ..... A47C 7/002 16/42 R
3,755,855 A 9/1973 Ouw et al.
4,915,335 A * 4/1990 Miles ..... A47C 7/002 248/188.8
5,427,342 A 6/1995 Gagnon
5,820,217 A * 10/1998 Horner ..... A47B 91/12 297/344.11
6,219,882 B1 * 4/2001 Olson ..... A47B 91/066 16/42 R
6,866,338 B2 * 3/2005 Mendenhall ..... A47C 1/124 16/18 CG
7,431,249 B2 * 10/2008 Hornberger ..... A47B 91/00 16/42 R
D617,631 S * 6/2010 Bushey ..... D8/374
8,407,855 B2 4/2013 Gagnon
2005/0183234 A1 1/2005 Bushey
2006/0054755 A1 * 3/2006 Hornberger ..... A47B 91/06 248/188.9
2007/0132291 A1 * 6/2007 Smith ..... A47C 3/04 297/239
2007/0186374 A1 * 8/2007 Thaw ..... A47C 7/002 16/42 R (Continued)

*Primary Examiner* — Jason W San

(57) ABSTRACT

A chair leg mountable coaster assembly includes a plate that is mountable to one of a plurality of legs of a chair. The plate extends laterally from the leg in a single direction that is orientated parallel to a plane that extends through bottom ends of the plurality of legs. The plate is one of a plurality of the plates, each of which is configured to be mountable to a respective one of the plurality of the legs so that each leg is engaged with one of the plates. The plates reduce penetration of the legs into a soft substrate, such as sand, dirt, and soil. The plates are sized to allow multiple ones of the chairs to be stacked without interference by the plates.

6 Claims, 6 Drawing Sheets

(56) References Cited

U.S. PATENT DOCUMENTS

| | | | | |
|---|---|---|---|---|
| 2008/0244870 | A1* | 10/2008 | Chase | A47B 91/06<br>16/42 R |
| 2010/0187399 | A1* | 7/2010 | Chase | A47B 91/06<br>248/688 |
| 2010/0229346 | A1* | 9/2010 | Chiu | A47B 91/06<br>16/42 T |
| 2013/0117965 | A1* | 5/2013 | Sievers | A47C 7/002<br>16/18 R |
| 2014/0125093 | A1* | 5/2014 | Kassanoff | A47C 3/00<br>297/183.1 |
| 2014/0203619 | A1* | 7/2014 | Dapra | A47C 7/008<br>297/463.1 |
| 2017/0164744 | A1* | 6/2017 | Ballendat | A47C 7/002 |
| 2019/0000231 | A1* | 1/2019 | Quintong | A47B 37/04 |

* cited by examiner

CHAIR LEG MOUNTABLE COASTER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to coaster assemblies and more particularly pertains to a new coaster assembly for reducing penetration of chair legs into a soft substrate such as sand, dirt, and soil.

(2) Description of Related Art Including Information Disclosed Under 37 CFR 1.97 and 1.98

The prior art relates to chair leg stabilizers utilized for preventing chair legs from sinking into sand. However, prior art chair leg stabilizers are circumferentially larger than the leg they are attached to. Though this shape effectively distributes the weight of the chair over large area relative to the leg, these devices interfere with the ability to stack chair utilizing these stabilizers.

BRIEF SUMMARY OF THE INVENTION

An embodiment of the disclosure meets the needs presented above by generally comprising a plate that is mountable to one of a plurality of legs of a chair. The plate extends laterally from the leg in a single direction that is orientated parallel to a plane that extends through bottom ends of the plurality of legs. The plate is one of a plurality of the plates, each of which is mountable to a respective one of the plurality of the legs so that each leg is engaged with one of the plates. The plates reduce penetration of the leg into a soft substrate. The plates are sized so that inner limits of the plates are separated by a distance that permits stacking of multiple ones of the chairs, with the stacked multiple ones of the chairs having an overall height that is comparable to that obtained when stacked multiple ones of the chairs lack the plates.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
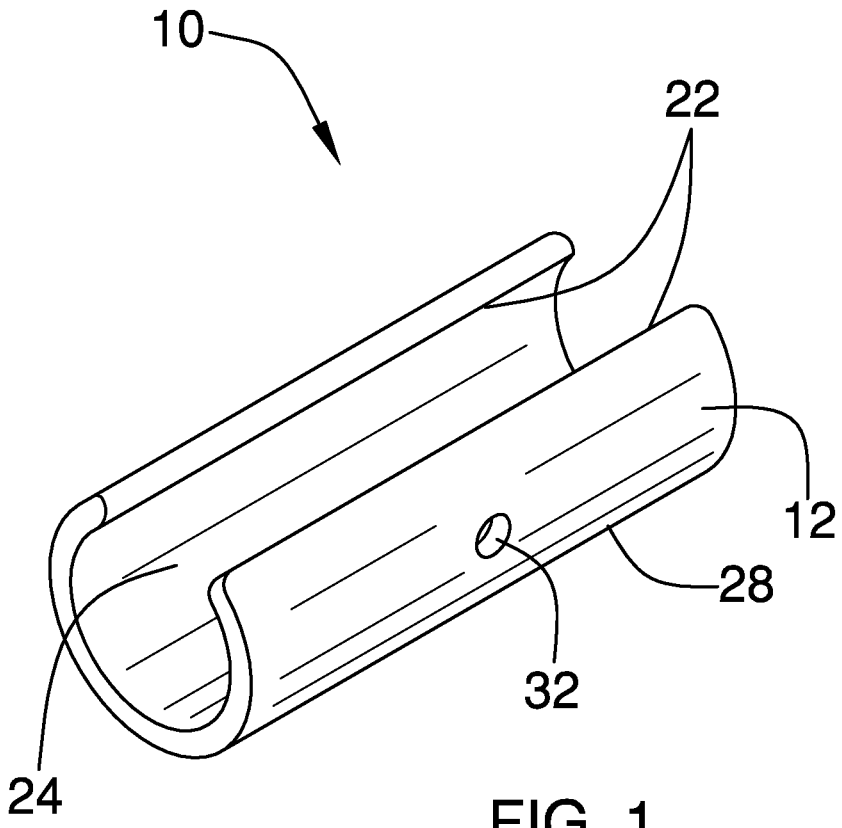
FIG. 1 is an isometric perspective view of a chair leg mountable coaster assembly according to an embodiment of the disclosure.
Figure 2:
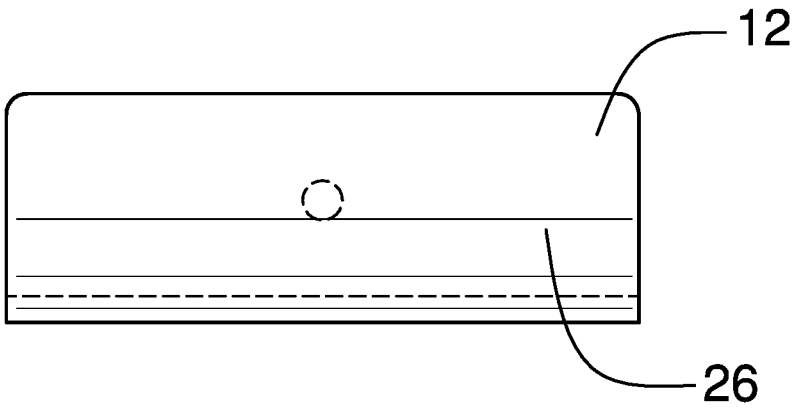
FIG. 2 is a side view of an embodiment of the disclosure.

With reference now to the drawings, and in particular to FIGS. 1 through 7 thereof, a new coaster assembly embodying the principles and concepts of an embodiment of the disclosure and generally designated by the reference numeral 10 will be described.

As best illustrated in FIGS. 1 through 7, the chair leg mountable coaster assembly generally comprises a plate 12 that is configured to be mountable to one of a plurality of legs 14 of a chair 16. The plate 12 extends laterally from the leg 14 in a single direction that is orientated parallel to a plane 18 that extends through bottom ends 20 of the plurality of legs 14. The plate 12 is configured to reduce penetration of the leg 14 into a soft substrate, such as sand, dirt, and soil. The present invention also anticipates the plates 12 being integral to the leg 14.

The plate 12 may be curved between opposed lateral edges 22, as shown in FIG. 1, so that the plate 12 is substantially tubularly shaped. The opposed lateral edges 22 are positioned coplanarly and spaced from each other to define a slot 24 between the opposed lateral edges 22. The slot 24 is configured to receive the bottom end 20 of the leg 14.

The plate 12 may comprise moderately flexible material, such as semirigid elastomers, so that the slot 24 can be widened to allow insertion of the bottom end 20 the leg 14. Rebounding of the plate 12 causes the opposed lateral edges 22 to contact the leg 14, thereby frictionally coupling the plate 12 to the leg 14. The present invention also anticipates the plate 12 being planar and thus configured to be positioned substantially flatly upon the soft substrate.

Figure 3:
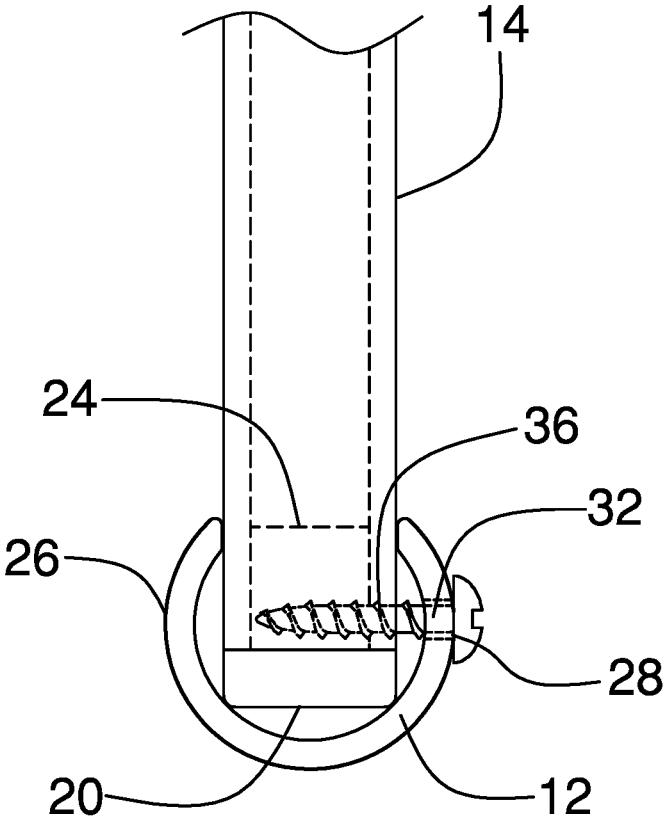
FIG. 3 is an end view of an embodiment of the disclosure.
Figure 4:
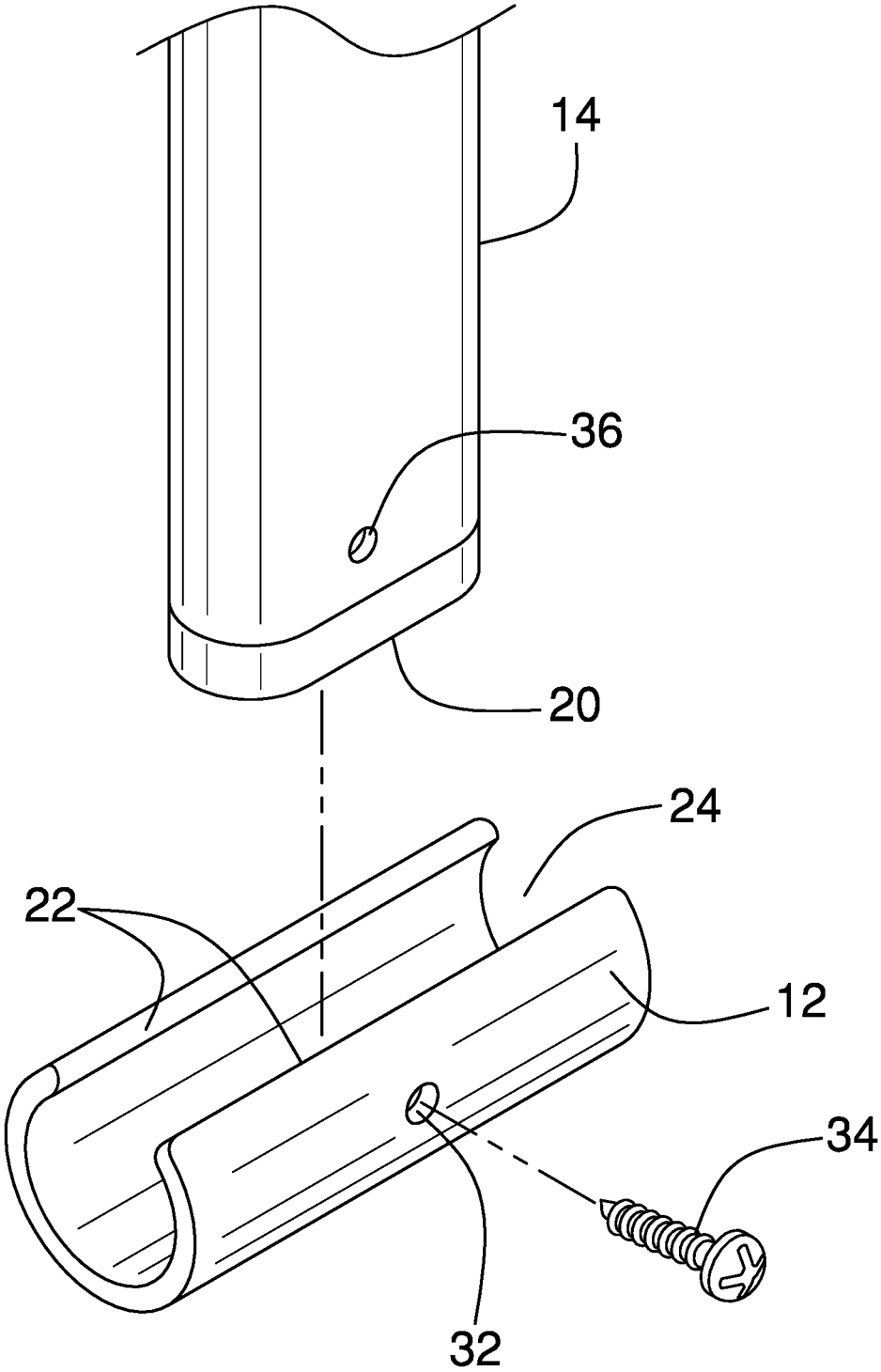
FIG. 4 is an exploded view of an embodiment of the disclosure.
Figure 5:
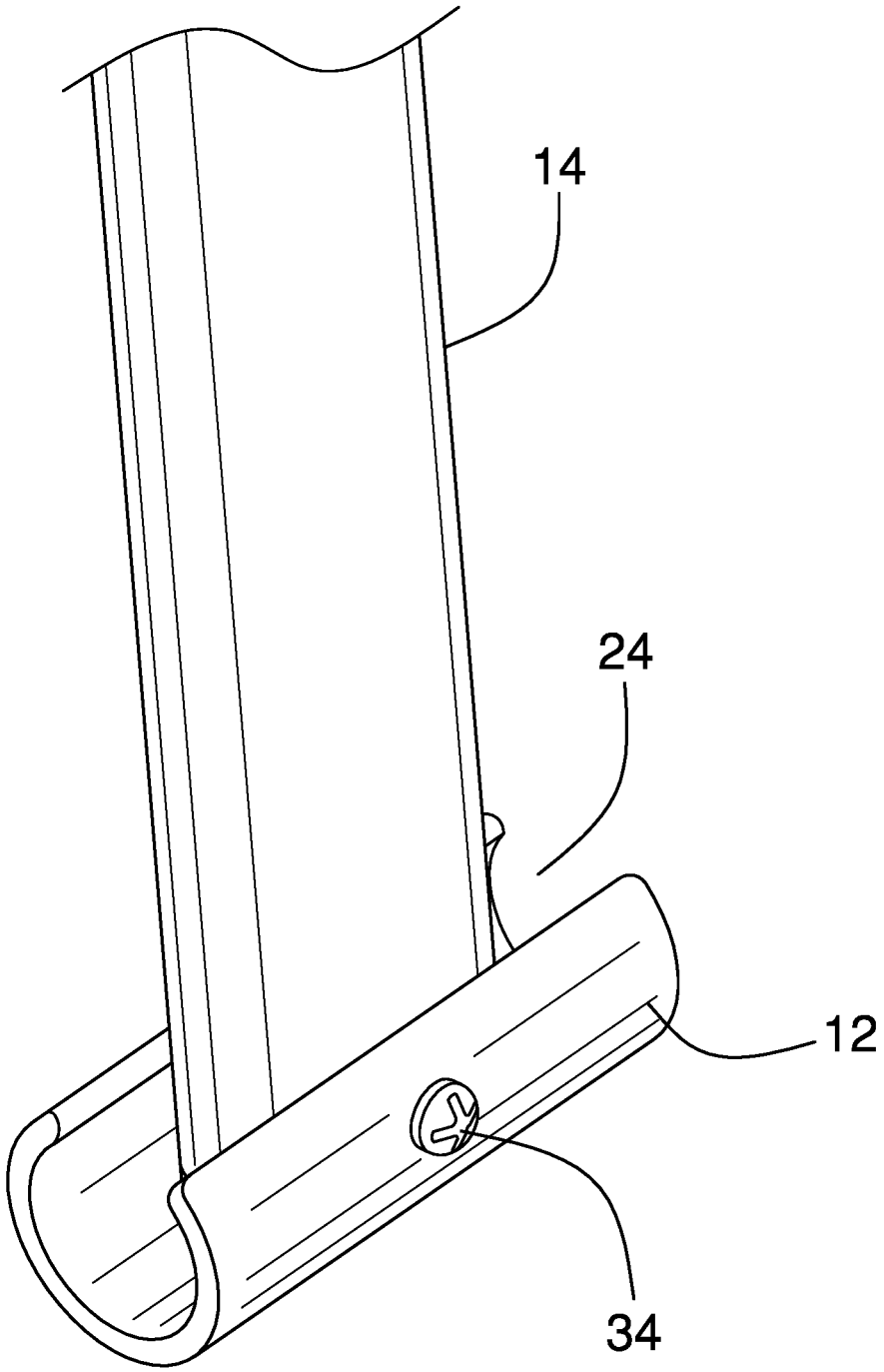
FIG. 5 is a detail view of an embodiment of the disclosure.

The plate 12 may be a substantially cylindrically shaped, as shown in FIG. 1, with the slot 24 equally spaced between and inner limit 26 and an outer limit 28 of the plate 12. A coupler 30 that is engaged to the plate 12 is configured to releasably engage the leg 14 of the chair 16. The plate 12 has a hole 32 that extends therethrough proximate to the slot 24. The coupler 30 comprises a fastener 34 that is extendable through the hole 32 and is configured to extend into the leg 14, as shown in FIG. 3. The coupler 30 also may comprise other coupling means, such as, but not limited to, adhesives, rivets, and the like.

Figure 6:
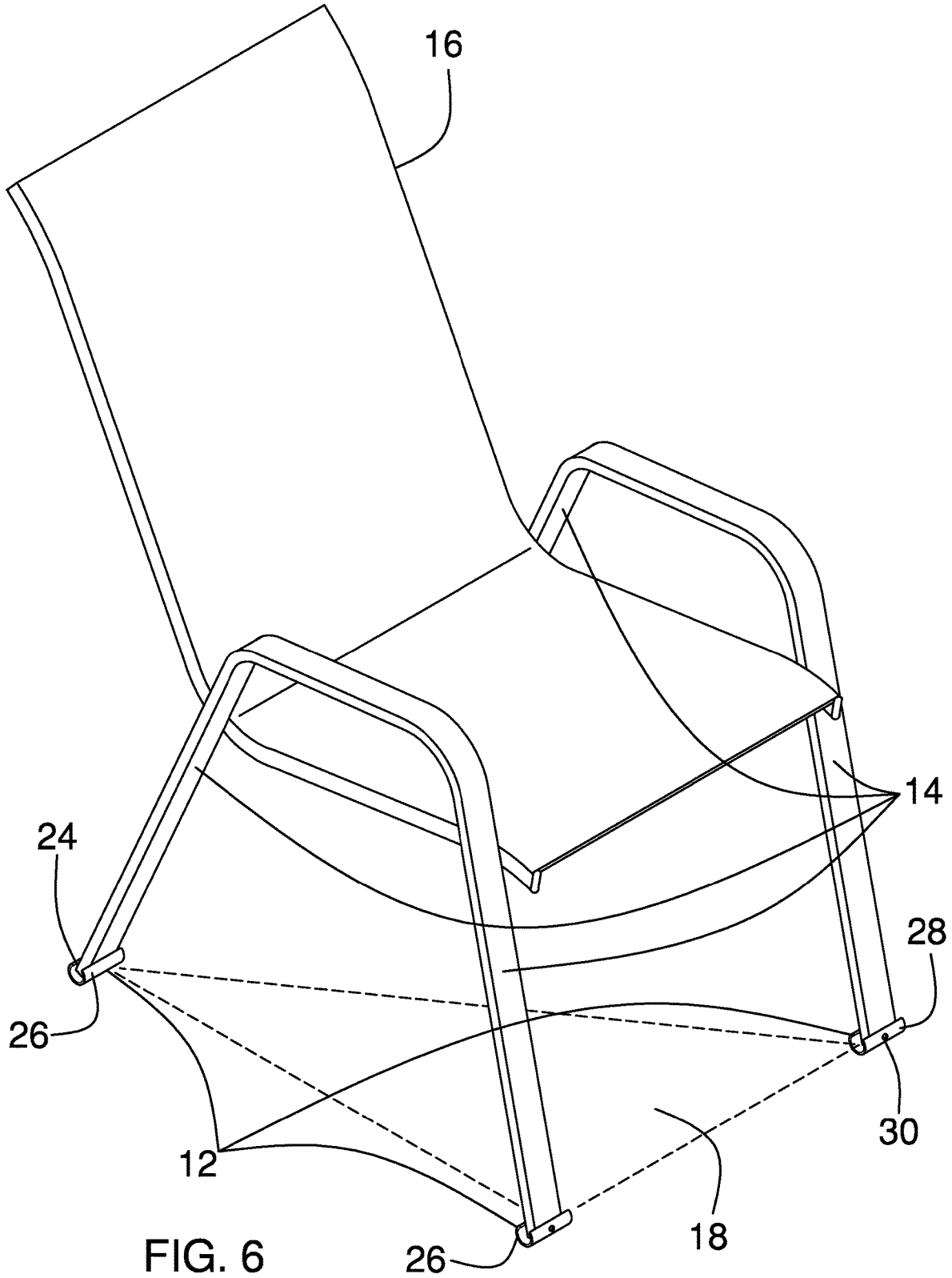
FIG. 6 is an in-use view of an embodiment of the disclosure.
Figure 7:
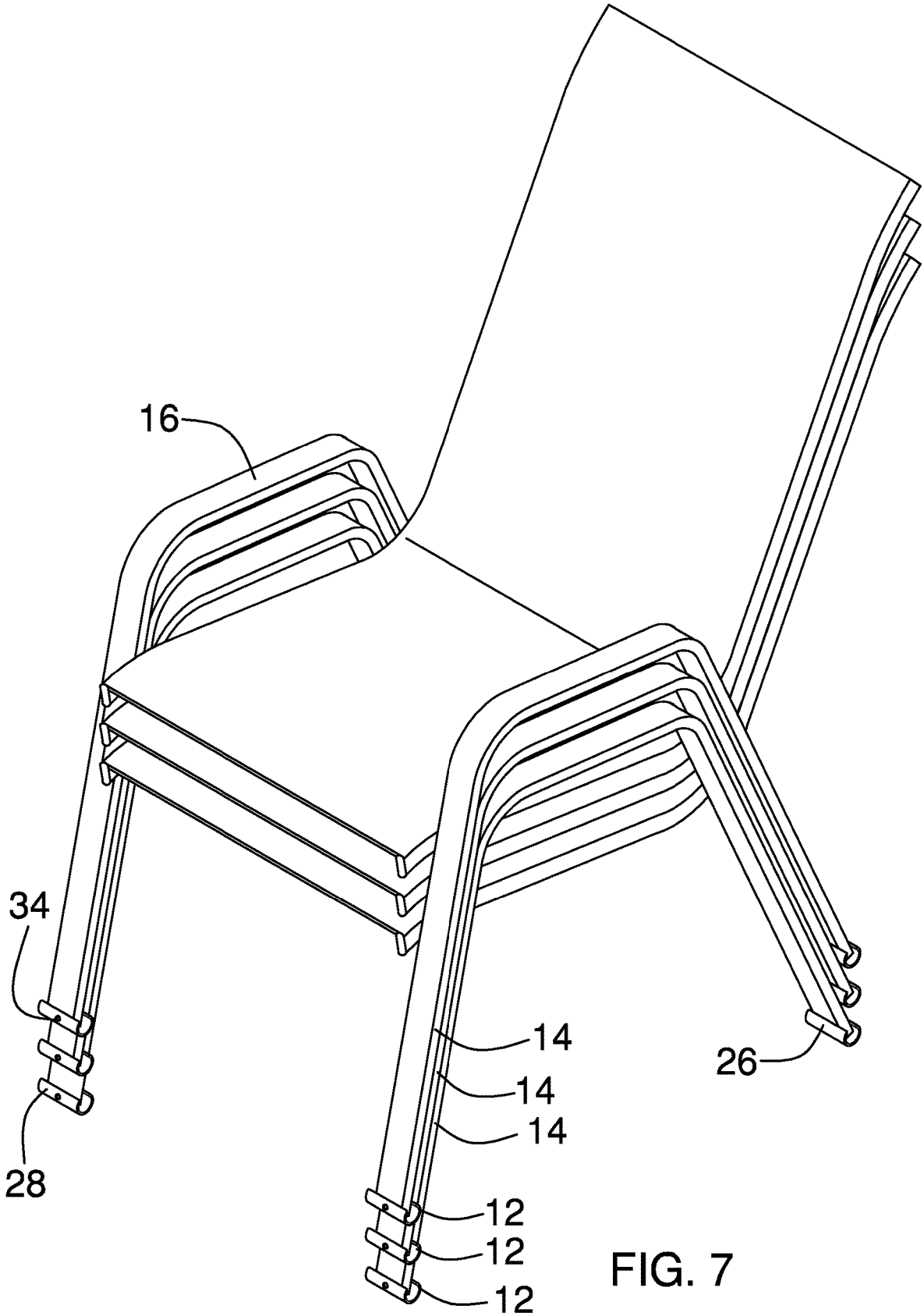
FIG. 7 is an in-use view of an embodiment of the disclosure.

The plate 12 is one of a plurality of the plates 12, each of which is configured to be mountable to a respective one of the plurality of legs 14 so that each leg 14 is engaged with one of the plates 12, as shown in FIG. 6. The plates 12 are sized so that the inner limits 26 of the plates 12 are separated by a distance that permits stacking of multiple ones of the chairs 16, as shown in FIG. 7. The stacked multiple ones of the chairs 16 have an overall height that is comparable to that obtained when stacked multiple ones of the chairs 16 lack the plates 12.

The present invention also may comprise a bit (not shown) that is complementary to the fastener 34 and a set of instructions (not shown) for drilling an orifice 36 in the leg 14 and for attachment of the plate 12 to the leg 14 of the chair 16.

In use, the leg 14 of the chair 16 is inserted into the slot 24 and the plate 12 is secured to the leg 14 by extending the fastener 34 through the hole 32 into the leg 14. With each leg 14 engaged to one of the plates 12 of the plurality of plates 12, the plates 12 are configured to reduce penetration of the legs 14 into the soft substrate upon which the chair 16 is positioned. The plates 12 are sized to allow multiple ones of the chairs 16 to be stacked without interference by the plates 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A chair and chair leg mountable coaster assembly combination comprising:

a chair comprising a plurality of legs, the chair being configured such that multiple ones of the chairs are stackable;

a plate selectively mountable to one of the plurality of legs, the plate extending laterally from the leg in a single direction that is orientated parallel to a plane extending through bottom ends of the plurality of legs, wherein the plate is configured for reducing penetration of the leg into a soft substrate, wherein the plate is curved between opposed lateral edges such that the plate is substantially tubularly shaped, wherein the opposed lateral edges are positioned coplanarly and spaced from each other to define a slot between the opposed lateral edges wherein the plate forms a straight cylinder having the slot extending between opposite ends of the straight cylinder, wherein the slot is configured to receive the bottom end of the leg, the plate having a first outer edge and a second outer edge wherein each of the first and second lateral edges extend between the first and second outer edges, the first and second outer edges each being vertically orientated, the first and second edges each being open to said slot, a distance between the first and second outer edges being sized to be greater than the bottom ends of the legs wherein the leg mounted to the plate is positioned between and spaced from each of the first and second outer edges, the plate being positioned between the leg and the soft substrate; and a plurality of the plates each being selectively mountable to a respective one of the plurality of legs such that each leg is engaged with one of the plates, the plates being sized such that inner limits of the plates are separated by a distance permitting stacking of multiple ones of the chairs, with the stacked multiple ones of the chairs having an overall height comparable to that obtained when stacked multiple ones of the chairs lack the plates.

2. The chair leg mountable coaster assembly combination according to claim 1, wherein the plate is substantially cylindrically shaped, the slot being equally spaced between the inner limit and an outer limit of the plate.

3. The chair leg mountable coaster assembly combination according to claim 1, further including a coupler engaging the plate and being configured to releasably engage the leg of the chair.

4. The chair leg mountable coaster assembly combination according to claim 1, further including a coupler engaging the plate and being configured to releasably engage the leg of the chair.

5. The chair leg mountable coaster assembly combination according to claim 2, further including a coupler engaging the plate and being configured to releasably engage the leg of the chair.

6. The chair leg mountable coaster assembly combination according to claim 5, wherein the plate has a hole extending therethrough proximate to the slot, the coupler comprising a fastener extendable through the hole and being configured to extend into the leg.

* * * * *